US008509999B2

(12) United States Patent
Suzuki et al.

(10) Patent No.: US 8,509,999 B2
(45) Date of Patent: Aug. 13, 2013

(54) ABNORMAL OPERATION DETECTION DEVICE

(75) Inventors: Hideaki Suzuki, Hitachi (JP); Yoshinori Furuno, Tsuchiura (JP); Kouichi Shibata, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 162 days.

(21) Appl. No.: 12/865,274

(22) PCT Filed: Jan. 27, 2009

(86) PCT No.: PCT/JP2009/051255

§ 371 (c)(1),
(2), (4) Date: Jul. 29, 2010

(87) PCT Pub. No.: WO2009/096383

PCT Pub. Date: Aug. 6, 2009

(65) Prior Publication Data

US 2011/0010059 A1 Jan. 13, 2011

(30) Foreign Application Priority Data

Jan. 30, 2008 (JP) ..... 2008-018485

(51) Int. Cl.
*G06F 7/70* (2006.01)

(52) U.S. Cl.
USPC ..... 701/50

(58) Field of Classification Search
None
See application file for complete search history.

(56) References Cited

U.S. PATENT DOCUMENTS

| | | | | |
|---|---|---|---|---|
| 5,482,138 | A * | 1/1996 | Mori et al. | 184/6.4 |
| 7,222,051 | B2 * | 5/2007 | Shibata et al. | 702/184 |
| 7,574,821 | B2 * | 8/2009 | Furem | 37/348 |
| 7,817,021 | B2 * | 10/2010 | Date et al. | 340/438 |
| 2004/0167701 | A1 * | 8/2004 | Mattson et al. | 701/71 |
| 2005/0151845 | A1 * | 7/2005 | Tsukada et al. | 348/148 |
| 2005/0154509 | A1 * | 7/2005 | Schubert et al. | 701/29 |
| 2005/0154512 | A1 * | 7/2005 | Schubert et al. | 701/38 |
| 2005/0184475 | A1 * | 8/2005 | Hamm | 280/5.502 |
| 2005/0184476 | A1 * | 8/2005 | Hamm | 280/5.502 |
| 2006/0031042 | A1 * | 2/2006 | Ogura et al. | 702/184 |
| 2006/0249919 | A1 * | 11/2006 | Suzuki et al. | 280/5.511 |
| 2007/0176375 | A1 * | 8/2007 | Barth et al. | 280/5.5 |
| 2008/0129000 | A1 * | 6/2008 | Munday et al. | 280/5.502 |
| 2009/0009308 | A1 * | 1/2009 | Date et al. | 340/439 |

FOREIGN PATENT DOCUMENTS

| | | |
|---|---|---|
| JP | 09-217702 | 8/1997 |
| JP | 2000-282517 | 10/2000 |
| JP | 2002-304441 | 10/2002 |
| KR | 10-1998-018018 | 6/1998 |
| KR | 10-2005-0053329 | 6/2005 |

OTHER PUBLICATIONS

Office Action issued in Korean Patent Application No. 10-2010-7016811 on Dec. 27, 2012.

* cited by examiner

*Primary Examiner* — Mussa A Shaawat
(74) *Attorney, Agent, or Firm* — Antonelli, Terry, Stout & Kraus, LLP.

(57) ABSTRACT

The invention provides an abnormal operation detection device estimating an overload operation of a hydraulic shovel on the basis of an amount of hydraulic operation. An accumulated amount of an operation amount is calculated by an accumulated amount calculating means on the basis of an operation amount of each of operation mechanisms obtained by an operation pressure detecting means, an operation fluctuation amount is calculated by a fluctuation amount calculating means, a joint angle of each of the operation mechanisms is estimated on the basis of the accumulated amount, and an overload operation is determined by using an abnormal operation determining means on the basis of the estimated joint angle and the operation fluctuation amount.

14 Claims, 12 Drawing Sheets

FIG.10

| | BOOM RISE | BOOM DOWN | ARM CLOUD | ARM DAMP | BUCKET CLOUD | BUCKET DAMP |
|---|---|---|---|---|---|---|
| EXCAVATING WORK | POSITIVE, SMALL | NEGATIVE, MIDDLE | NEGATIVE, SMALL | POSITIVE, MIDDLE | NEGATIVE, SMALL | POSITIVE, MIDDLE |
| LIFTING WORK | POSITIVE, MIDDLE | NEGATIVE, MIDDLE | NEGATIVE, MIDDLE | POSITIVE, MIDDLE | NEGATIVE, MIDDLE | POSITIVE, MIDDLE |
| SOIL DISCHARGING WORK | POSITIVE, MIDDLE | NEGATIVE, MIDDLE | NEGATIVE, MIDDLE | POSITIVE, MIDDLE | NEGATIVE, MIDDLE | POSITIVE, MIDDLE |
| RETURNING WORK | POSITIVE, LARGE | NEGATIVE, LARGE | NEGATIVE, LARGE | POSITIVE, LARGE | NEGATIVE, MIDDLE | POSITIVE, MIDDLE |
| PREPARING WORK | POSITIVE, LARGE | NEGATIVE, LARGE | NEGATIVE, LARGE | POSITIVE, LARGE | NEGATIVE, LARGE | POSITIVE, MIDDLE |

PRIOR ART
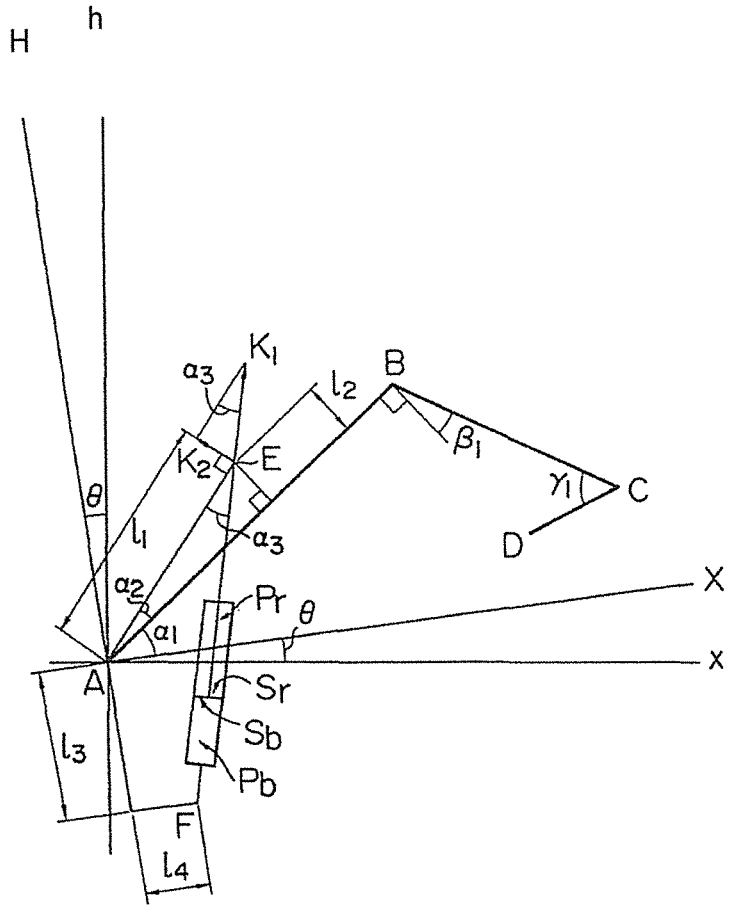
FIG. 17 (step 808)

ABNORMAL OPERATION DETECTION DEVICE

BACKGROUND OF THE INVENTION (1) Field of the Invention

The present invention relates to an abnormal operation detection device detecting an overload operation of an excavating machine such as a hydraulic shovel or the like.

(2) Description of Related Art

In a general industrial equipment such as a construction machine, a machine tool or the like, there is a structure which is demanded of continuously operating all the time without stopping, and it is necessary to keep the equipment in an infallible state in advance in accordance with a maintenance work before an abnormal stop. Generally, a good equipment state is maintained by executing a periodical inspection by an expert maintenance worker in accordance with an inspection work, searching whether or not an abnormal portion exists, and carrying out a necessary maintenance work in the case that any abnormality is found. On the other hand, since there is generated a necessity of stopping the equipment in order to execute an inspection and maintenance work, the inspection and maintenance work can come to an obstacle for operation for an operator who would like to continuously operate, as long as the equipment state is good.

Further, there is a diagnostic technique detecting an abnormal state of the equipment by a diagnosing apparatus, however, there is a case that a relevant sensor is necessary for diagnosing. However, in the light of reducing a cost of the machine, a sensor which is not necessarily required for controlling is apt to be omitted. In addition, there is a case that a suitable sensor corresponding to the information to be collected does not actually exist, it comes to a problem in the light of a preventive maintenance preventing a failure of the equipment in advance.

The construction machine in addition to the hydraulic shovel is previously designed in such a manner as to stand up to a severe working environment. However, a user may carry out a usage which is not assumed in the design, and there is a case that a maintenance work such as a parts exchange or the like is necessary in an earlier stage than an assumed design standard, by being executed a work which is not recommended by a maker side. This is not desirable for both the user and the maker.

In response to this problem, there is disclosed a technique which is going to manage a work content. In patent document 1 (JP-A-2002-304441), there is disclosed a technique of measuring a kind of a work and a workload by estimating a working condition from an operation information of a working machine. However, in the patent document 1, a potentiometer is used for estimating the working condition, and this technique can not be applied to a machine which is not provided with a potentiometer. On the other hand, in patent document 2 (JP-A-9-217702), there is disclosed a technique of estimating a work content on the basis of an operation amount of various actuators. However, in the patent document 2, a broadcast work, a bumping work, a slope finishing work, a crane work, a compressing excavation work, a loading work, and a turning and road leveling work are assumed as the kind of the work. In order to discriminate these works, the structure is made such as to calculate a boom operation complexity, a bucket operation complexity, a high-speed turning time, a boom inverse operation time, a bucket arm stop time, a boom operation amount average value, an arm operation amount average value and a bucket operation amount average value on the basis of the operation amounts of the various actuators, and detecting an overload operation (an abnormal operation) of a machine which corresponds to a problem to be solved by the present invention is not assumed.

BRIEF SUMMARY OF THE INVENTION

The present invention is made by taking the above points mentioned above into consideration, and an objet of the present invention is to estimate an overload operation of a construction machine on the basis of an operation amount of a hydraulic operation mechanism or the like so as to prevent a failure of a machine in advance.

In order to achieve the object mentioned above, in accordance with the present invention, there is provided an abnormal operation detection device of a machine provided with an operation mechanism for excavating, including an operation mechanism transmitting plural kinds of operation commands of an operator to the operation mechanism, an accumulated amount calculating means calculating an accumulated amount of an operation amount of the operation mechanism on the basis of a coefficient in correspondence to the operation amounts of a plurality of the operation mechanisms, a fluctuation amount calculating means calculating a fluctuation amount of the operation amount of the operation mechanism, an operation position estimating means estimating an operation position of the operation mechanism on the basis of the accumulated amount, and an abnormal operation detecting means detecting an overload operation of the machine on the basis of the estimated operation position and the fluctuation amount.

Further, in order to achieve the object mentioned above, in accordance with the present invention, there is provided an abnormal operation detection device of a hydraulic shovel for excavating, including a hydraulic operation mechanism transmitting plural kinds of operation commands of an operator, an accumulated amount calculating means calculating an accumulated amount of operation amounts of the hydraulic operation mechanism on the basis of a coefficient in correspondence to operation amounts of a plurality of the hydraulic operation mechanisms, a fluctuation amount calculating means calculating a fluctuation amount of the operation amount of the hydraulic operation mechanism, an angle estimating means estimating a joint angle or a turning angle of the hydraulic shovel on the basis of the accumulated amount, and an abnormal operation detecting means detecting an overload operation of the hydraulic shovel on the basis of an estimated angle by the angle estimating means and the fluctuation amount.

Further, the abnormal operation detection device in accordance with the present invention is provided with an abnormal operation storage means storing an overload operation of the machine or the hydraulic shovel while adding a date in a memory device provided in the device or connected thereto, at a time of detecting the overload operation.

Further, the abnormal operation detection device in accordance with the present invention is provided with an informing means informing an operator of the detection of the overload operation of the machine or the hydraulic shovel, at a time of detecting the overload operation.

Further, the abnormal operation detection device in accordance with the present invention is provided with a message means informing an external portion of the detection of the overload operation of the machine or the hydraulic shovel by using a communication device connected to the abnormal operation detection device, at a time of detecting the overload operation.

Further, the abnormal operation detection device in accordance with the present invention carries out an initialization of the estimated operation position or the estimated angle of the machine or the hydraulic shovel.

Further, in order to achieve the object mentioned above, in accordance with the present invention, there is provided an abnormal operation detection device of a machine provided with an arm operation mechanism by a hydraulic pressure, including a means estimating a joint angle of the arm on the basis of an operation amount of the hydraulic pressure corresponding to the operation mechanism, and an abnormal operation determining means measuring a fluctuation amount of the hydraulic operation so as to detect with or without an overload operation, in the case that an estimated joint angle satisfies a fixed condition.

Further, the abnormal operation detection device in accordance with the present invention carries out an initialization of the means estimating the joint angle of the arm.

Further, the abnormal operation detection device in accordance with the present invention is provided with an abnormal operation storage means storing the detection of the overload operation while adding a data in a storage device provided within the apparatus or connected thereto, at a time of detecting the overload operation.

Further, the abnormal operation detection device in accordance with the present invention is provided with an informing means informing an operator of the detection of the overload operation, at a time of detecting the overload operation.

Effect of the Invention

In accordance with the abnormal operation detection device of the present invention, it is possible to estimate the joint angle on the basis of the operation amount of the hydraulic pressure corresponding to the operation mechanism of the hydraulic shovel without demanding any additional sensor such as the potentiometer or the like, it is possible to detect the overload operation such as a double bench construction method or the like by measuring the fluctuation amount of the hydraulic operation in the case that the estimated joint angle satisfies the fixed condition, and it is possible to comprehend the used condition tending to cause the failure. Accordingly, it is possible to take a step such as a previous maintenance or the like in correspondence to the used condition.

BRIEF DESCRIPTION OF THE SEVERAL VIEWS OF THE DRAWING

FIG. 10 is a view explaining a set value of an embodiment in accordance with the present invention;

FIG. 17 is an explanation of the principle of calculation of the weight of a load in a conventional art.

DETAILED DESCRIPTION OF THE INVENTION

A description will be given below of embodiments in accordance with the present invention with reference to the accompanying drawings.

Embodiment 1

A description will be given of an embodiment in accordance with the present invention by using a construction machine such as a hydraulic shovel or the like, with reference to FIGS. 1 to 13.

Figure 1:
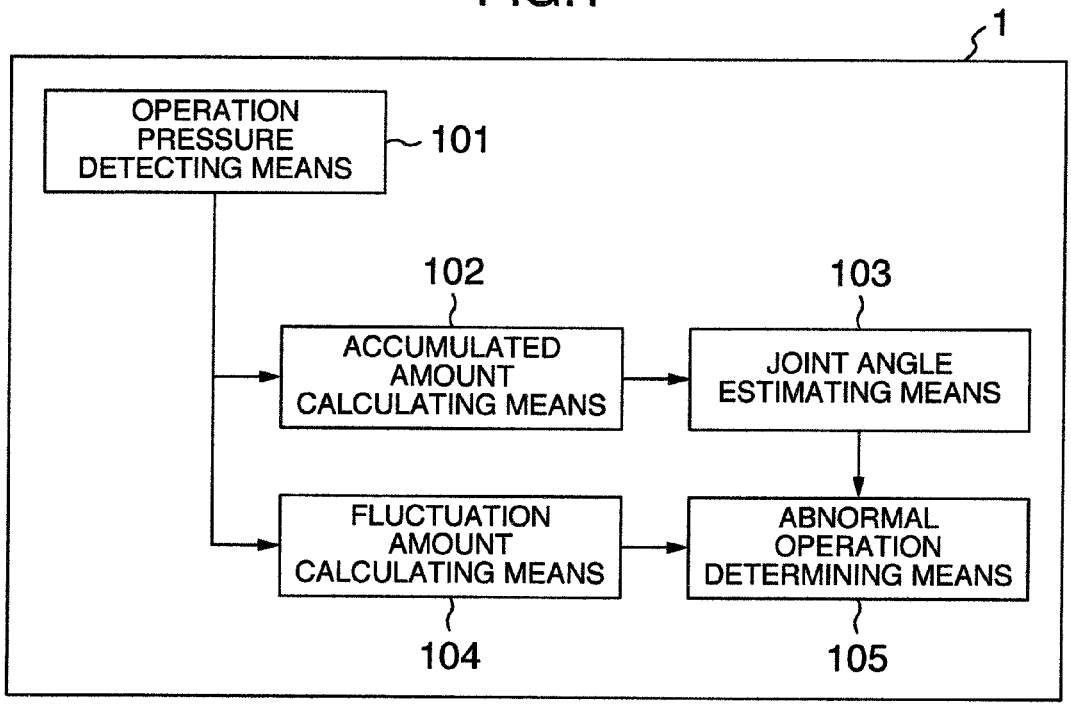
FIG. 1 is a view showing a structure of an embodiment in accordance with the present invention.

FIG. 1 is a block diagram for explaining a structure of an abnormal operation detection device in accordance with the present invention. In FIG. 1, an abnormal operation detection device 1 includes an operation pressure detecting means 101, an accumulated amount calculating means 102, a joint angle estimating means 103, a fluctuation amount calculating means 104 and an abnormal operation determining means 105. The abnormal operation detection device 1 achieves its function by being mounted to a construction machine such as a hydraulic shovel or the like. The operation pressure detecting means 101 detects what operation an operator of the construction machine carries out, by being connected to a sensor information of a hydraulic operation mechanism (not shown) of the hydraulic shovel. The accumulated amount calculating means 102 calculates an accumulated amount in a time direction with regard to the operation pressure of the hydraulic pressure detected by the operation pressure detecting means 101. In the case of calculating the accumulated amount, it is calculated by using a coefficient mentioned below. A joint angle of each of mechanisms of the construction machine is estimated on the basis of the accumulated amount calculated by the accumulated amount calculating means 102. Further, the fluctuation amount calculating means 104 calculates a fluctuation amount in the time direction with regard to the operation pressure of the hydraulic pressure detected by the operation pressure detecting means 101. The abnormal operation determining means 105 determines whether or not the operation is applicable to a condition of the abnormal operation, on the basis of the estimated joint angle of each of the mechanisms output by the joint angle estimating means 103 and the fluctuation amount output by the fluctuation amount calculating means 104, and outputs a result thereof.

Figure 2:
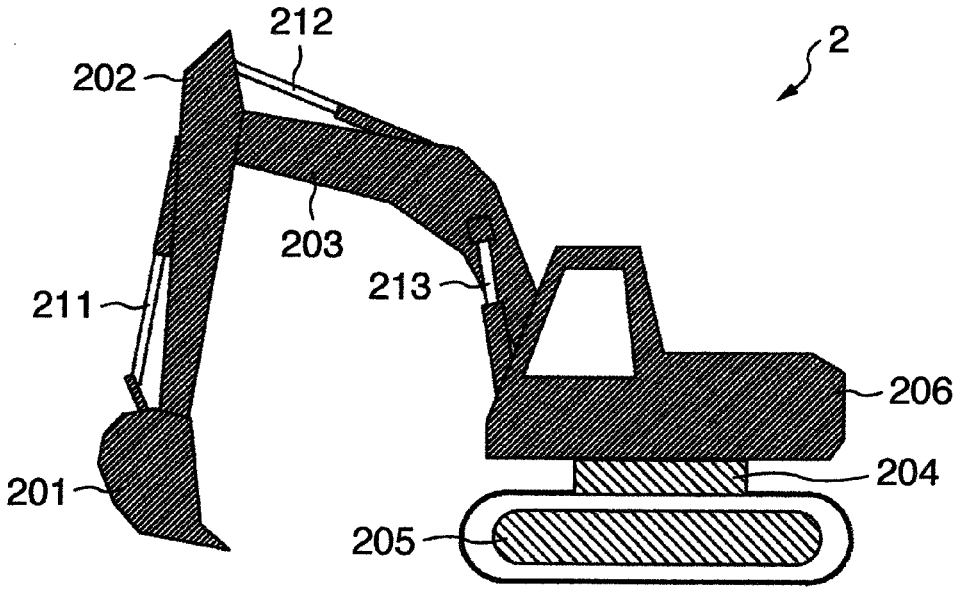
FIG. 2 is a view explaining a hydraulic shovel.
Figure 3:
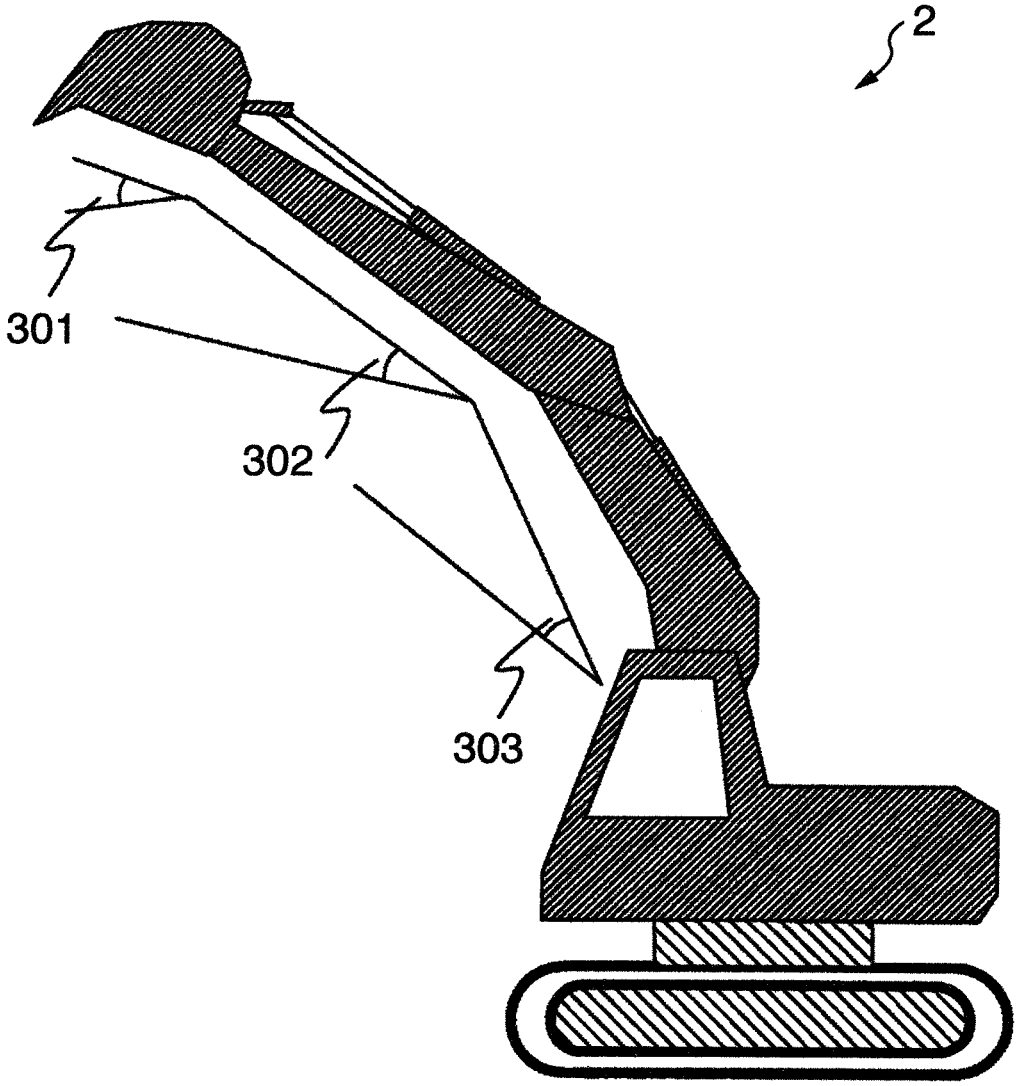
FIG. 3 is a view explaining the hydraulic shovel.
Figure 4:
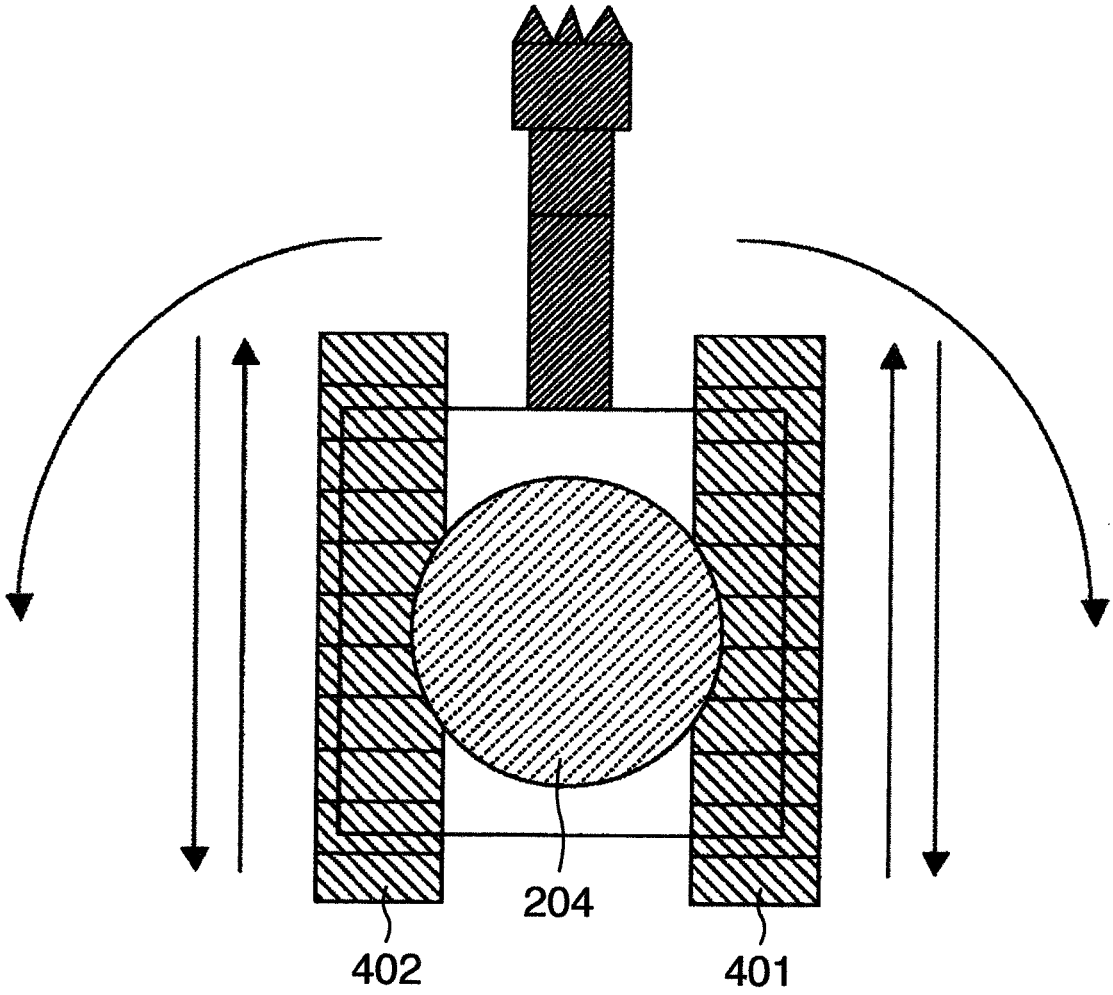
FIG. 4 is a view explaining the hydraulic shovel.

A description will be given of an operation of the hydraulic shovel with reference to FIGS. 2 to 4. The hydraulic shovel 2 can carry out an operation such as an excavation or the like by each of operation mechanisms provided therein. A bucket 201, an arm 202 and a boom 203 are operated by cylinders 211, 212 and 213. It is often the case that a whole of the portions in connection with the excavation is called as a front. The bucket 201, the arm 202, the boom 203 and the like are activated on the basis of an expansion and contraction operation of the cylinders 211 to 213. As a result, it is possible to change a joint angle 301 of a portion connecting the bucket 201 and the arm 202, a joint angle 302 of a portion connecting the arm 202 and the boom 203, and a joint angle 303 of a portion connecting the boom 203 and a main body 206 as shown in FIG. 3, however, since the joint angle is not necessary for operating the hydraulic shovel 2, a sensor measuring an angle is not attached. A controller (a control apparatus: not shown) for controlling each of the operation mechanism, and collecting and monitoring the information from the sensor is mounted to the hydraulic shovel 2, however, since it does not have any sensor information directly measuring the joint angles 301, 302 and 303 as mentioned above, an attitude information of the operation mechanism is not input to the controller. Further, the hydraulic shovel 2 is provided with a turning mechanism 204 rotating the main body 206 and a crawler (a crawler belt) 205 serving as a driving mechanism of a whole of the hydraulic shovel as shown in FIG. 2. The crawlers 205 are provided in right and lefts sides, and are structured such as to be independently activated respectively. For example, a right crawler 401 and a left crawler 402 simultaneously rotate in a forward direction as shown in FIG. 4, whereby the hydraulic shovel can move forward, however, if the right crawler 401 rotates forward and the left crawler 402 rotates backward, a whole of the hydraulic shovel rotates as a whole in a counterclockwise direction. The turning mechanism 204 is structured such that only an upper portion of a main body rotates.

Figure 5:
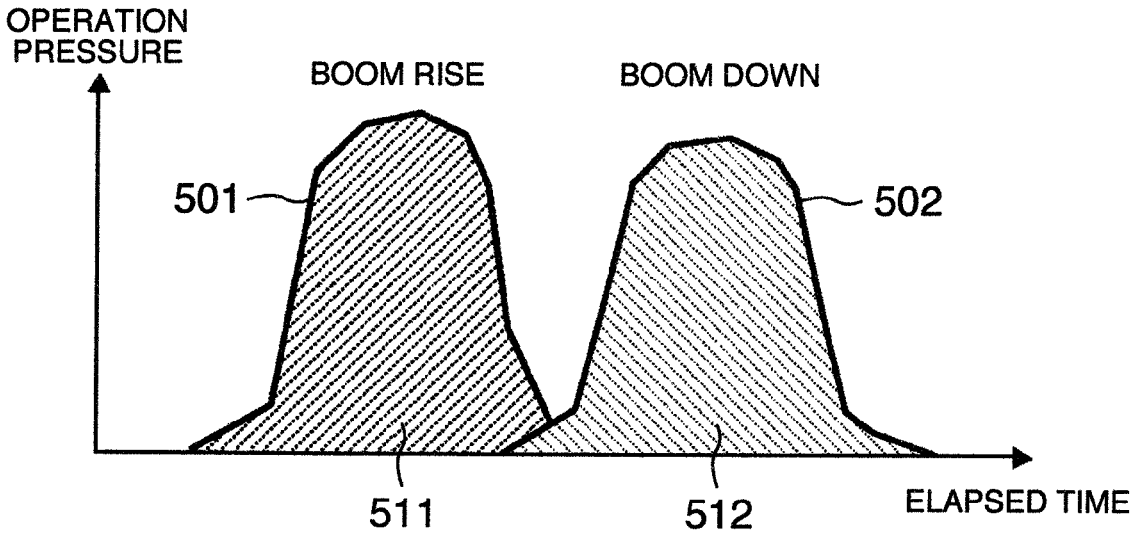
FIG. 5 is a view explaining an operation of an embodiment in accordance with the present invention.
Figure 6:
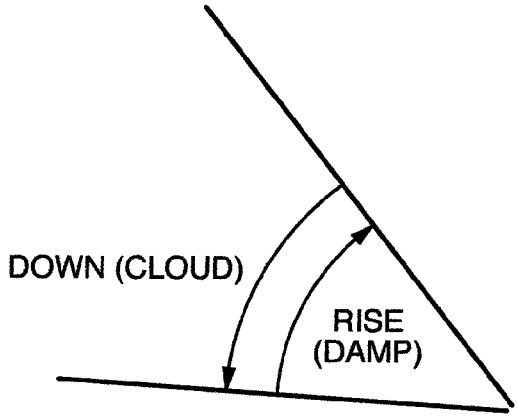
FIG. 6 is a view explaining an operation of an embodiment in accordance with the present invention.

An example of an operation pressure measured by the operation pressure detecting means 101 is shown in FIG. 5. FIG. 5 shows the operation pressure of a vertical motion of the boom 203, and shows a boom rising operation pressure 501 and a boom falling operation pressure 502. When the boom 203 is operated neither upward nor downward, the boom 203 is retained at its position (joint angle). As shown in FIG. 6, in the case of the arm 202 and the bucket 203, a motion in an upward direction is called as a dump, and a motion in a downward direction is called as a crowd. In addition to the boom 203, any operation mechanism is basically activated in correspondence to an applied pressure, however, since the measured element is the applied pressure, it does not always move at that degree. For example, since the excavating operation or the like varies in correspondence to a hardness of an excavated soil or the like, a moving amount of the cylinder of the operation mechanism, that is, a rotating speed of the joint is changed with respect to the applied force. In FIG. 5, in the case that the operation is not an operation coming to a load with respect to the operation mechanism such as the excavating operation or the like, that is, only a moving operation is simply carried out, an integral in the time direction of the operation pressure (a boom rising total operation amount 511 or a boom falling total operation amount 512 in FIG. 5) is in proportion to a cylinder moving amount of the boom, that is, a change amount of the joint angle of the boom.

A description will be given of a method of estimating the joint angle with reference to FIGS. 7, 8 and 10.

Figure 7:
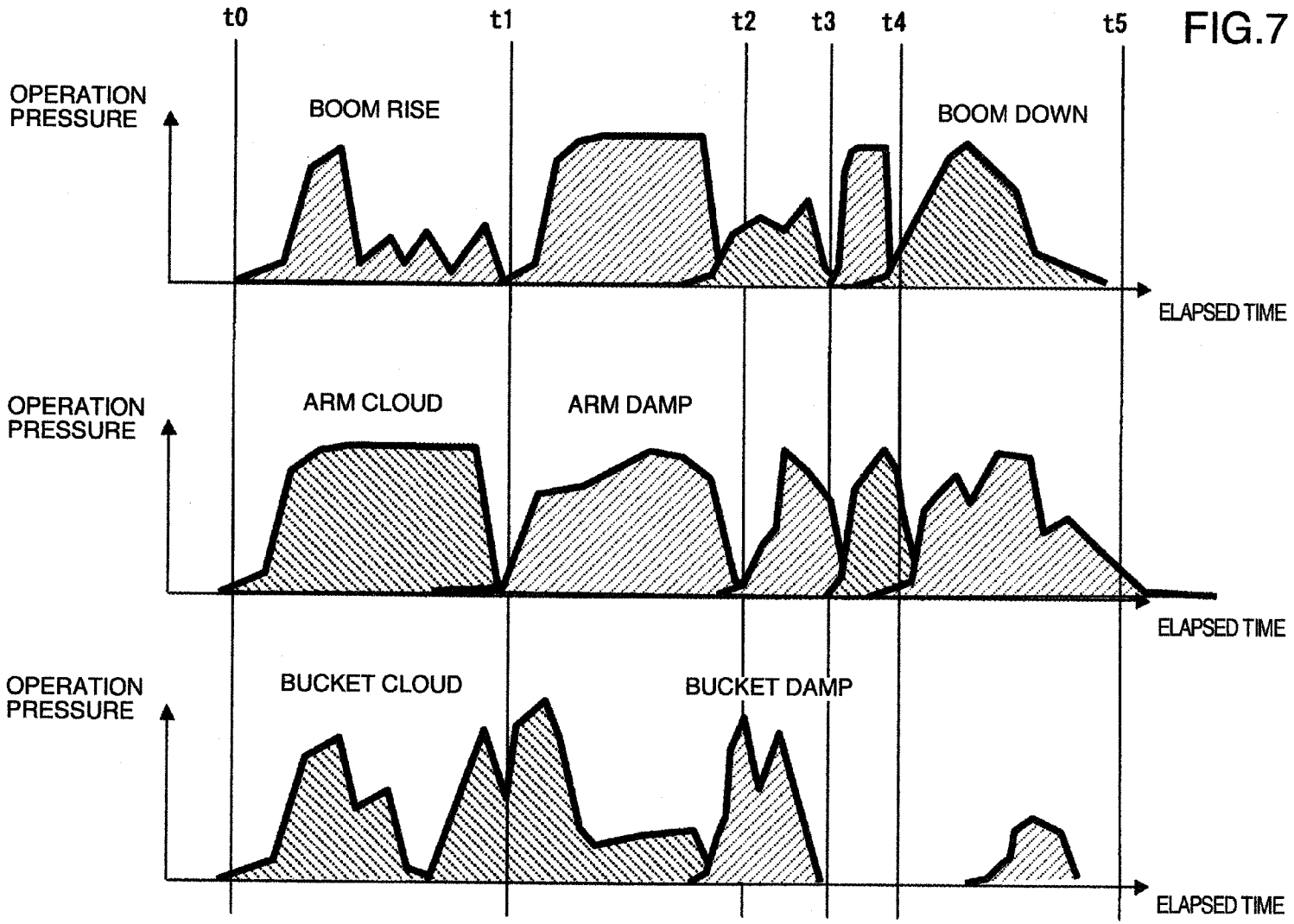
FIG. 7 is a view explaining an operation of an embodiment in accordance with the present invention.

FIG. 7 shows a time change of each of the operation pressures of the boom 203, the arm 202 and the bucket 201, with regard to a series of excavating operation of the hydraulic shovel. A segmentation of a time from t0 to t5 shown in FIG. 7 means a cut line of the series of operation, the time t0 to t1 is called as an excavating work, the time t1 to t2 is called as a lifting work, the time t2 to t3 is called as a soil discharging work, the time t3 to t4 is called as a returning work, and the time t4 to t5 is called as a preparing work, respectively.

The excavating work is a work for digging out the soil by using a shovel, the lifting work is a work for lifting the dug soil for loading to a carriage work vehicle such as a dump car or the like, and the turning operation is simultaneously carried out during this time. The soil discharging work is a work for loading the soil to the carriage work vehicle, and the returning work and the preparing work mean an operation folding the front portion of the shovel so as to extend for starting the next excavating work.

Figure 8:
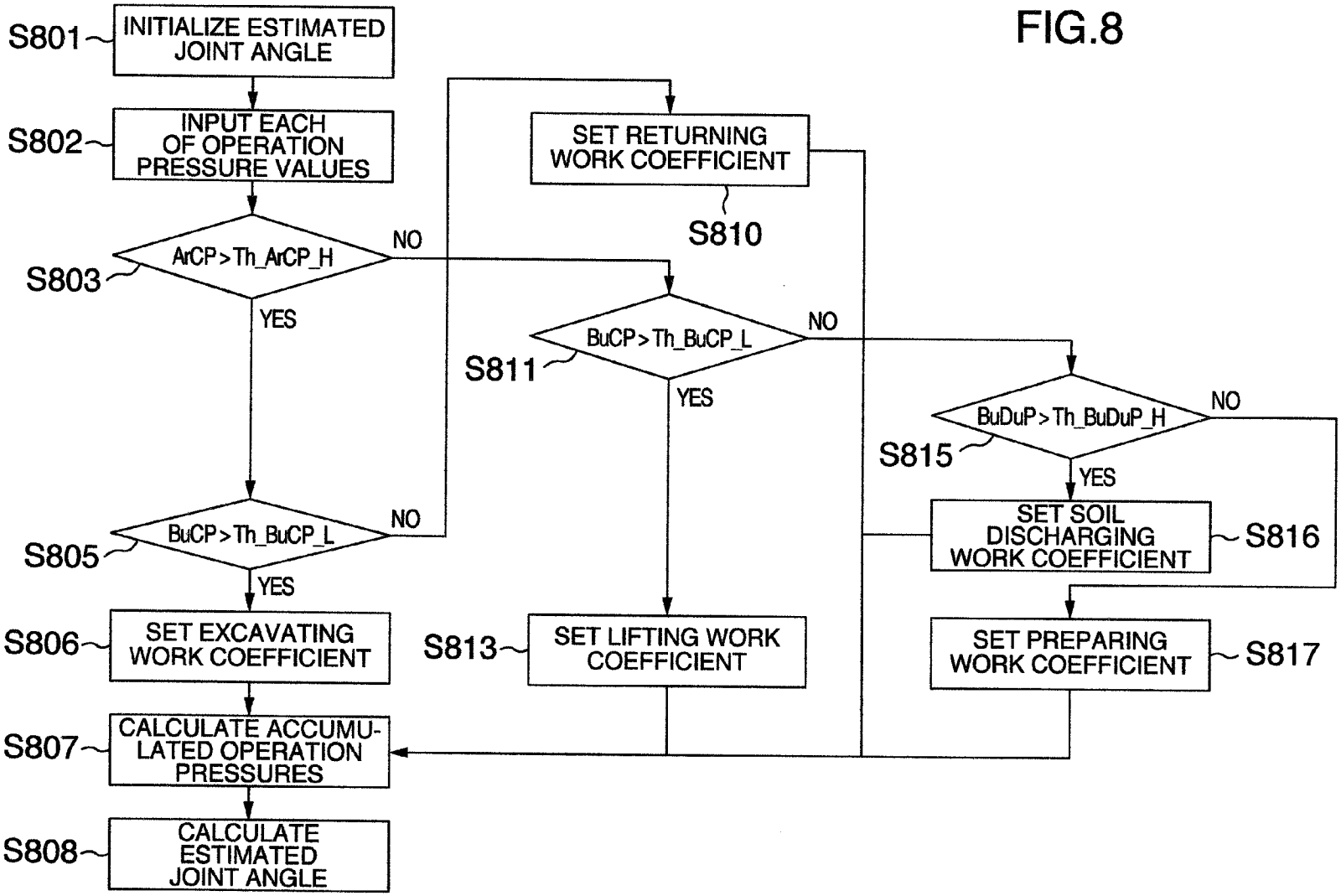
FIG. 8 is a flow chart explaining an operation of an embodiment in accordance with the present invention.

FIG. 8 shows a flow of a method of estimating the joint angle. As a major flow, an accumulated operation pressure is calculated in each of the boom 203, the arm 202 and the bucket 201, by discriminating the kind of the work mentioned above, multiplying an integrated value of each of the operation pressures by a coefficient set per operation pressure in accordance with the kind of the work, and adding in the case of the rising (dump) operation or subtracting in the case of the falling (crowd) operation, and the joint angle is estimated by using this.

First of all, each of the joint angles is initialized in a step 801. Since the hydraulic shovel is fixed in a set attitude at a time of stopping, the initialization in the step 801 is executed at timing such as just after starting an engine or the like. Next, the step inputs a value of the operation pressure of each of the operation mechanisms measured by the operation pressure detecting means 101 at each of time instants (a step 802). The step determines whether or not an arm crowd pressure value (ArCP in the drawing) is larger than a threshold value Th_ArCP_H in the input values (a step 803). This is for discriminating the section in which the arm crowd pressure value indicates the larger value than the fixed value such as the section t0-t1 or t3-t4 in FIG. 7, whereby it is possible to discriminate which of the excavating work or the returning work, and the other works the work is. In the case that the condition of the step 803 is satisfied, the step goes to a step 805, and determines whether or not a bucket crowd pressure value (BuCP in the drawing) is equal to or larger than a set threshold value Th_BuCP_L. Accordingly, it is possible to discriminate which of the excavating work and the returning work the work is. If the work is determined as the excavating work, an excavating work coefficient is set in a step 806, and if the work is determined as the returning work, a returning work coefficient is set in a step 810. In the case that the condition of the step 803 is not satisfied, the step determines whether or not the bucket crowd pressure value (BuCP) is larger than the threshold value Th_BuCP_L (a step 811), if it is the larger value, the step determines that it is the lifting work, and sets a lifting work coefficient (a step 813). If it is determined that it is not the lifting work, the step goes to a step 815, and determines whether or not a bucket dump pressure value (BuDuP in the drawing) is larger than a threshold value Th_BuDuP_H. If it is the larger value, the step determined that the work is the soil discharging work and sets a soil discharging work coefficient (a step 816). If the step determines that the work is not the loading work, the step determines that it is the preparing work and sets a preparing working coefficient (a step 817). If each of the work coefficients is set in the step 806, the step 810, the step 813, the step 816 and the step 817, the step calculates a value obtained by multiplying by the working coefficient per the operation pressure value, and the accumulated operation pressure value is calculated per the operation pressure value. With respect to a step 808 is performed by a calculation of a weight of a load performed by a second embodiment of the invention described in FIG. 9 of U.S. Pat. No. 4,627,013 (now FIG. 17 in the present application) with the structure of an angle detector, described in U.S. Pat. No. 6,930,423 is a typical example incorporated in the present application by references.

In FIG. 17 *h* and x designate a vertical axis and a horizontal axis, respectively, centered at the pivot A of pivotal movement of the boom as viewed from the ground and constitute coordinates with the pivot A of pivotal movement of the boom serving as the origin 0 which correspond to the coordinates shown in FIG. 2 and FIG. 3. X and H designate a vertical axis and a horizontal axis, respectively, centered at the pivot A as viewed from the upper swing tilting by an angle θ. As shown, the angle θ is obtained when the upper swing tilts in a direction opposite the direction in which the front attachment is located. When the upper swing tilts toward the front attachment, the angle θ of inclination is a negative angle.

In the front cylinder 212 of the hydraulic excavator in this condition, the moment of rotation $M_1$ with about the pivot A due to the total weight of the front cylinder 213 and the moment of rotation given by the component $K_2$ of the pressing force $K_1$ exerted by the boom cylinder balance, so that the moment $M_1$ can be expressed as follows:

$$M_1=k_2\times I_1=K_1 \sin \alpha_3\times I_1 \quad (a)$$

The angle $\alpha_3$ can be expressed with different equations. The pressing force $K_1$ exerted by the boom cylinder can be expressed as follows because the boom cylinder is two in number, one mounted on one side of the front attachment and the other on the other side thereof:

$$K_1=2\times(P_bS_b-P_rS_r)$$

Therefore, equation (a) can be rewritten as follows:

$$M1=2\times(P_bS_b-P_rS_r)\times I_1\times\cos\phi \quad (b)$$

Let the moment $M_1$ be assumed to be one obtained when the bucket 201 carries a load. It will be seen that equation (b) that the angle of inclination of the upper swing 206 has no effect on the calculation of the moment $M_1$.

$$ArP=\int(\alpha arc(m)\cdot ArCP(t)+\alpha ardu(m)\cdot ArDup(t))dt \quad (1)$$

In this case, αarc(m) and αardu(m) are respectively the working coefficients about the arm crowd and the arm dump, and indicate different values in accordance with the determined working kinds m. A value obtained by multiplying the working coefficient and the operation pressure values of the arm crowd and the arm dump, and integrating them in the time direction comes to the accumulated arm operation pressure value ArP. An example of the working coefficient per the operation pressure and the working kind becomes as shown in FIG. 10. A portion inscribed by "positive" indicates that a positive value is given, and a portion inscribed by "negative" indicates that a negative value is given. Signs "large", "middle" and "small" indicate a magnitude of the coefficients. For example, the arm rising gives the positive value and increases the accumulated arm operation pressure Arp, and the arm falling gives the negative value and reduces the accumulated arm operation pressure ArP. In order to convert the accumulated arm operation pressure ArP into an estimated arm angle ear, the following calculation expression (2) is used.

$$\theta ar=\beta ar\cdot Arp \quad (2)$$

Same applies to the boom (expressions 3 and 4) and the bucket (expressions 5 and 6), and they can be calculated by using the following expressions.

$$BoP=\int(\alpha bou(m)\cdot BoUP(t)+\alpha bod(m)\cdot BoDP(t))dt \quad (3)$$

$$\theta bo=\beta bo\cdot BoP \quad (4)$$

$$BuP=\int(\alpha buc(m)\cdot BuCP(t)+\alpha budu(m)\cdot BuDuP(t))dt \quad (5)$$

$$\theta bu=\beta bu\cdot BuP \quad (6)$$

Figure 9:
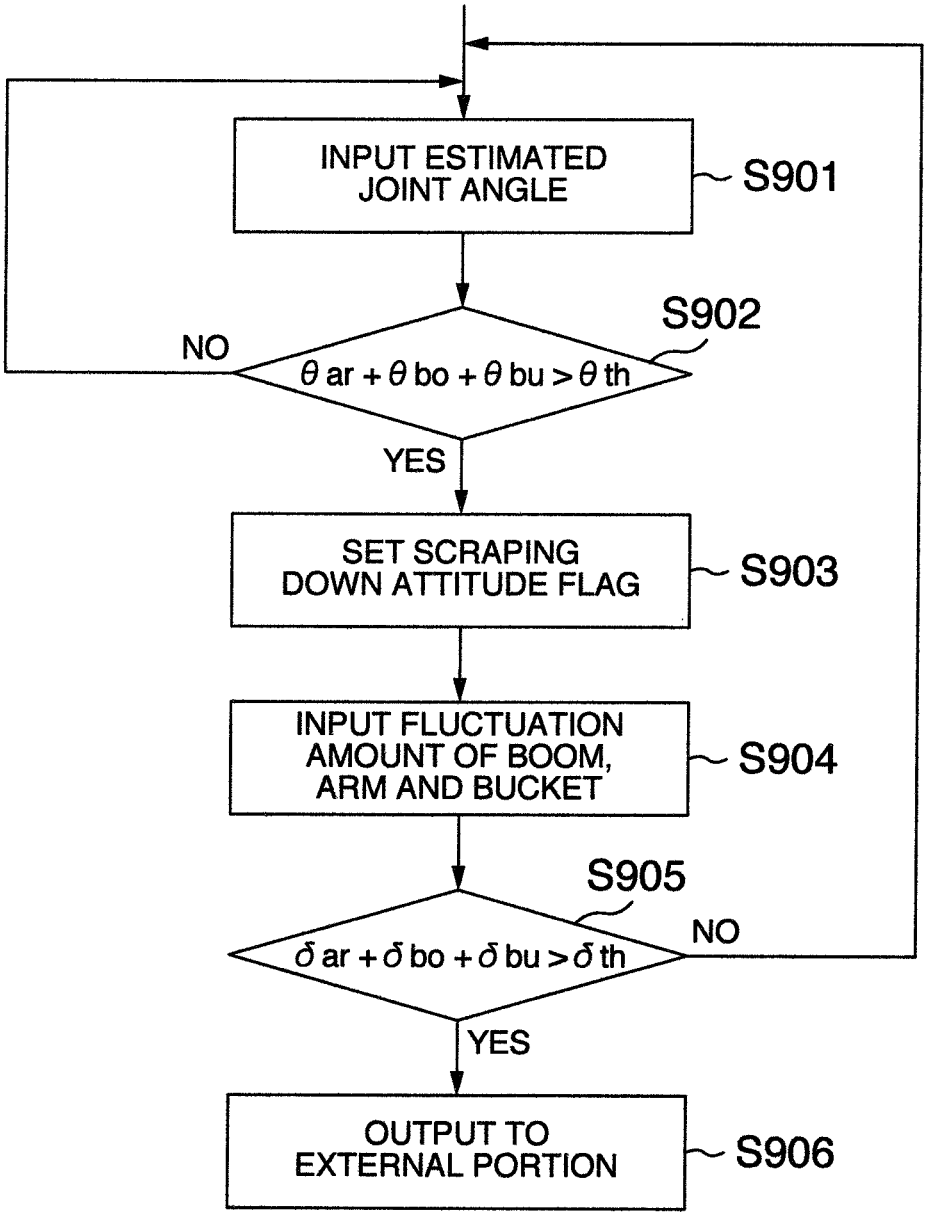
FIG. 9 is a flow chart explaining an operation of an embodiment in accordance with the present invention.

FIG. 9 shows a flow after each of the joint angles is calculated. The step inputs the estimated joint angles θar, θbo and θbu of the respective joints output by the joint angle estimating means 103 (a step 901). The step determines a total of the estimated joint angles and determines whether or not this is beyond a previously set threshold value θth (a step 902). If the value θar+θbo+θbu is beyond the threshold value θth, the step sets a scraping down attitude flag (a step 903). Next, the step calculates fluctuation amounts δar, δbo and δbu of the respective operation pressures of the arm, the boom and the bucket and inputs them (a step 904). The fluctuation amounts δar, δbo and δbu of the operation pressures can be calculated by using the following expressions.

$$\delta ar=\text{avg}(|dArCP/dt|+|dArDuP/dt|) \quad (7)$$

$$\delta bo=\text{avg}(|dBoUP/dt|+|dBoDP/dt|) \quad (8)$$

$$\delta bu=\text{avg}(|dBuCP/dt|+|dBuDuP/dt|) \quad (9)$$

In the expressions 8 to 9, sign avg expresses an average value in a time direction, | | expresses an absolute value, dArCP/dt and the like express differential values of the operation pressures per unit time. The step calculates whether or not a total of the fluctuation amounts δar, δbo and δbu of the operation pressures is beyond a previously set threshold value δth. If the value δar+δbo+δbu is beyond the value δth, the step determines that the overload operation (the scraping down work) is carried out (a step 905), and outputs to an external portion of the abnormal operation detection device (a step 906).

Figure 11:
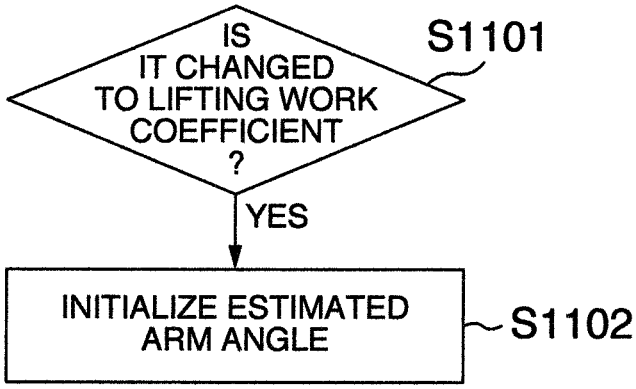
FIG. 11 is a flow chart explaining an operation of an embodiment in accordance with the present invention.
Figure 12:
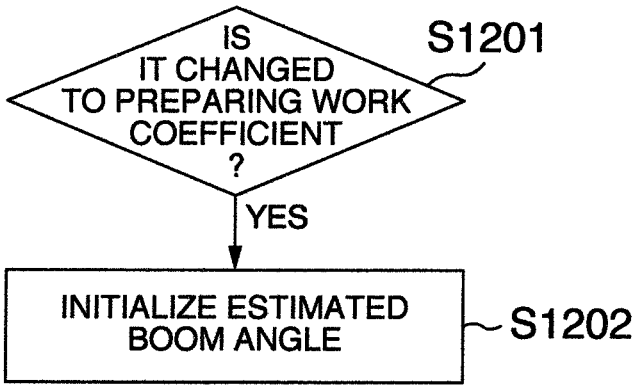
FIG. 12 is a flow chart explaining an operation of an embodiment in accordance with the present invention.
Figure 13:
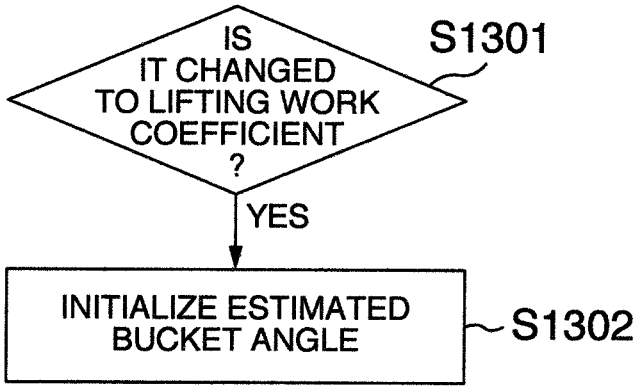
FIG. 13 is a flow chart explaining an operation of an embodiment in accordance with the present invention.

A description will be given of an initialization of the estimated arm angle with reference to FIG. 11. In the case that the lifting work coefficient is set by the flow shown in FIG. 8 (a step 813), the step confirms that the lifting work coefficient is set (a step 1101), and initializes the estimated arm angle (a step 1102). In the case of initializing, the step sets to a previously determined numerical value, for example, setting to 0. In the case that the estimated arm angle comes to a smaller value than the value for initialization (in the case that it comes to a negative value if the initial value is 0), the step may determine that the arm is crowded further than the initially estimated level, and may do such a process as to initialize at that time point.

A description will be given of an initialization of the estimated boom angle. In the case that the preparing work coefficient is set in the flow shown in FIG. 8 (a step 817), the step confirms that the preparing work coefficient is set (a step 1201), and initializes the estimated boom angle (a step 1202). In the case of initializing, the value is set to a previously determined numerical value, for example, setting to 0. In the case that the estimated boom angle comes to a smaller value than the value for initialization (in the case that it comes to a negative value if the initial value is 0), the step may determine that the boom is brought down further than an originally estimated level, and may do such a process as to initialize at that time point.

A description will be given of an initialization of the estimated bucket angle. In the case that the lifting work coefficient is set in the flow shown in FIG. 8 (a step 813), the step confirms that the lifting work coefficient is set (a step 1301), and initializes the estimated bucket angle (a step 1302). In the case of initializing, the value is set to a previously determined numerical value, for example, setting to 0. In the case that the estimated bucket angle comes to a smaller value than the value for initialization (in the case that it comes to a negative value if the initial value is 0), the step may determine that the bucket is crowded further than an originally estimated level, and may do such a process as to initialize at that time point.

Embodiment 2

A description will be given of the other embodiment in accordance with the present invention by exemplifying a construction machine such as a hydraulic shovel or the like, with reference to FIGS. 2 and 4, and FIGS. 14 to 16.

Figure 16:
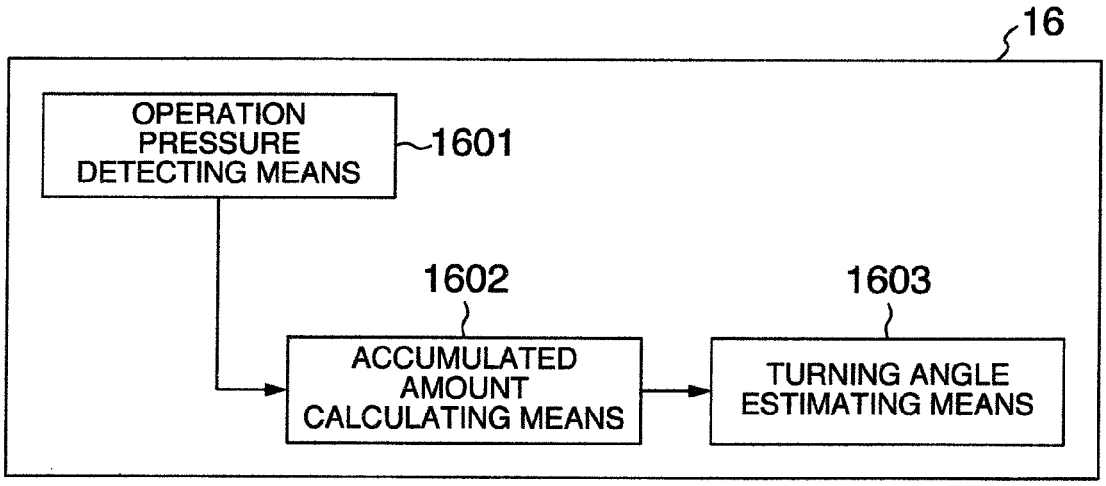
FIG. 16 is a view showing a structure of an embodiment in accordance with the present invention.

FIGS. 2 and 4 are the same as explained in the embodiment 1. FIG. 16 shows a structure of a turning angle estimating apparatus 16, and is constructed by an operation pressure detecting means 1601, an accumulated amount calculating means 1602 and a turning angle estimating means 1603.

The operation pressure detecting means 1601 detects pressure values of a rightward turning (clockwise) operation pressure and a leftward turning (counterclockwise) operation pressure. The accumulated amount calculating means 1602 calculates an accumulated value in a time direction of the right and left operation pressures detected by the operation pressure detecting means 1601. The turning angle estimating means 1603 calculates an estimated turning angle by multiplying an accumulated operation pressure calculated by the accumulated amount calculating means 1602 by a previously set coefficient. A computation expression for calculation can use the following expressions.

$$Sw=\int(\alpha swr\cdot Swr(t)+\alpha swl\cdot Swl(t))dt \quad (10)$$

$$\theta sw=\beta sw\cdot Sw \quad (11)$$

The accumulated turning operation pressure Sw is obtained by integrating a value obtained by multiplying a right turning operation pressure Swr by a coefficient $\alpha$swr (>0) and a value obtained by multiplying a left turning operation pressure Swl by a coefficient $\alpha$swl (<0) in the time direction. The estimated turning angle $\theta$sw is calculated by multiplying this by a previously determined coefficient $\beta$sw.

Figure 14:
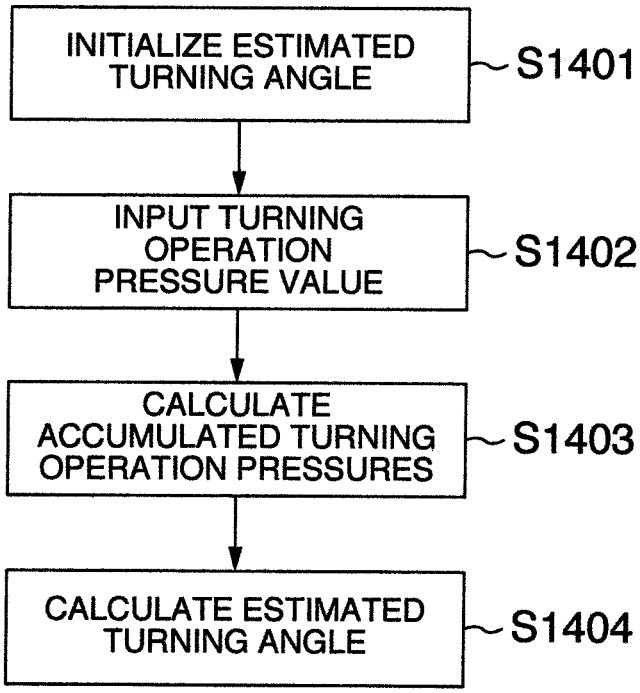
FIG. 14 is a flow chart explaining an operation of an embodiment in accordance with the present invention.

FIG. 14 shows an operation flow of the turning angle estimating apparatus 16. The step initializes the estimated turning angle (a step 1401), sequentially inputs the turning operation pressure value (a step 1402), calculates the accumulated operation pressure (a step 1403), and calculates the estimated turning angle (a step 1404).

Figure 15:
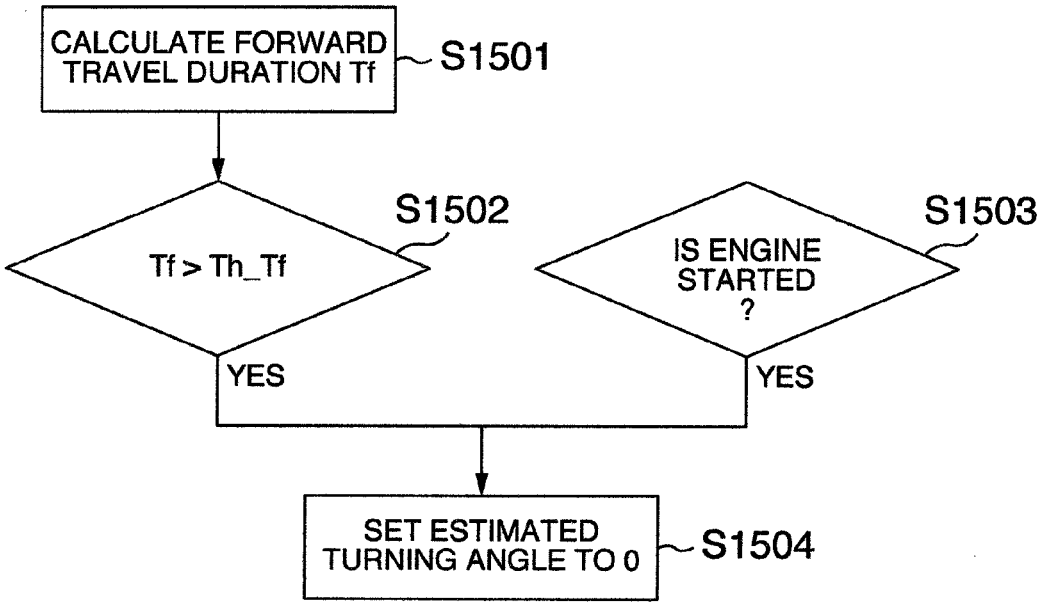
FIG. 15 is a flow chart explaining an operation of an embodiment in accordance with the present invention.

FIG. 15 shows an initializing flow of the estimated turning angle. The step calculates a forward travel duration Tf (a step 1501), and sets the estimated turning angle to 0 in the case that the forward travel duration Tf is beyond a previously set threshold value Th_Tf (a step 1504). Further, in the case that the engine comes to a start state from a stop state (a step 1503), the step sets the estimated turning angle to 0 (a step 1504). Two independent conditions are provided for initializing the estimated turning angle. They include a case that a whole of the shovel continuously moves forward, and a case that the engine is started. Since the operator generally carries out a forward moving operation by orientating a front to the forward moving direction, the turning angle is at a laterally neutral position. In the case that the forward moving operation is carried out while carrying out the turning operation, the initialization of the estimated turning angle is not carried out. In other words, the forward travel duration Tf mentioned above calculates a time for which the forward travel operation is carried out in a state in which the turning operation is not carried out. Further, since the construction machine stops generally in a state of orientating the front forward even at a time when the engine stops, the turning angle is at the laterally neutral position in the same manner. Since the turning operation can turn in the same direction continuously at 360 degree or more either rightward or leftward, it is possible to reword in the case that the estimated turning angle goes beyond 180 degree rightward and leftward. For example, in the case that rightward 200 degree turn is calculated, it is possible to interpret leftward 160 degree turn state.

It is possible to apply to a more complicated abnormal operation detection by combining the turning angle estimating apparatus 16 with the abnormal operation detection device 1 in accordance with the embodiment 1. For example, in the case that a previously set working range exists and it is intended to turn in a state in which the front is lifted up, it is possible to sense of a risk of coming into contact with a building or an obstacle outside the working range so as to inform the operator of it, or carry out such a control as to emergency stop the turning operation or the like. Further, the load is applied to the turning wheel by working while orientating the front at 90 degree (horizontally) with respect to the lower traveling body, it is possible to detect this as the abnormal operation.

INDUSTRIAL APPLICABILITY

It is possible to detect the operation coming to the overload to the construction machine so as to protect the machine, and it is possible to prevent the accident of the construction caused by the operation error of the operator.

The invention claimed is:

1. An abnormal operation detection device of a machine provided with an operation mechanism for excavating, comprising:

an operation measuring device that measures a hydraulic operation pressure transmitting plural kinds of operation commands of an operator to said operation mechanism;

an integrated amount calculating device that calculates an integrated value in time direction with regard to the hydraulic operation pressure on the basis of a coefficient in correspondence to kind of work of a plurality of said operation mechanisms;

a fluctuation amount calculating device that calculates a fluctuation amount of the hydraulic operation pressure;

an operation position estimating device that estimates an operation position of an arm of said operation mechanism on the basis of said integrated value, wherein said estimated operation position is calculated by multiplying said integrated value of each of the operation pressures by the coefficient set per operation pressure in accordance with the kind of the work, and adding in the case of the rising (dump) operation or subtracting in the case of the falling (crowd) operation; and an abnormal operation detecting device that detects an overload operation of said machine on the basis of said estimated operation position and said fluctuation amount;

wherein in calculation of said estimated operation position it is determined whether or not a joint output is beyond a previously set threshold value, If said joint output is beyond the threshold value, then an attitude flag is scraped down;

wherein in calculation of said estimated operation position it is further determined whether or not a total of the fluctuation amount of the of the hydraulic operation pressure is beyond a previously set threshold value, if the total of the fluctuation amount of the hydraulic operation pressure is beyond the threshold value than the overload operation is carried out, and outputs to an external portion of the abnormal operation detecting device.

2. An abnormal operation detection device of a hydraulic shovel for excavating, comprising:

a hydraulic operation measuring device that measures a hydraulic operation pressure transmitting plural kinds of operation commands of an operator;

an integrated amount calculating device that calculates an integrated value in time direction with regard to the hydraulic operation pressure on the basis of a coefficient in correspondence to kind of work of a plurality of said hydraulic operation mechanisms;

a fluctuation amount calculating device that calculates a fluctuation amount of the hydraulic operation pressure;

an angle estimating device that estimates a joint angle or a turning angle of said hydraulic shovel on the basis of said integrated value, wherein said angle is calculated by multiplying said integrated value of each of the operation pressures by the coefficient set per operation pressure in accordance with the kind of the work, and adding in the case of the rising (dump) operation or subtracting in the case of the falling (crowd) operation; and an abnormal operation detecting device that detects an overload operation of said hydraulic shovel on the basis of an estimated angle by said angle estimating device and said fluctuation amount;

wherein in calculation of said joint angle it is determined whether or not a joint output is beyond a previously set threshold value, If said joint output is beyond the threshold value, then an attitude flag is scraped down;

wherein in calculation of said joint angle it is further determined whether or not a total of the fluctuation amount of the of the hydraulic operation pressure is beyond a previously set threshold value, if the total of the fluctuation amount of the hydraulic operation pressure is beyond the threshold value than the overload operation is carried out, and outputs to an external portion of the abnormal operation detecting device.

3. An abnormal operation detection device as claimed in claim 1, further comprising an abnormal operation storage device that stores an overload operation of said machine while adding a date in a memory device provided in the device or connected thereto, at a time of detecting the overload operation.

4. An abnormal operation detection device as claimed in claim 1, further comprising an informing device that informs an operator of the detection of the overload operation of said machine, at a time of detecting the overload operation.

5. An abnormal operation detection device as claimed in claim 1, further comprising a message device that informs an external portion of the detection of the overload operation of said machine by using a communication device connected to the abnormal operation detection device, at a time of detecting the overload operation.

6. An abnormal operation detection device as claimed in claim 1, wherein the abnormal operation detection device carries out an initialization of said estimated operation position or said estimated angle of said machine.

7. An abnormal operation detection device of a machine provided with an arm operation mechanism by a hydraulic pressure, comprising:

a device that estimates a joint angle of the arm on the basis of an integrated value in time direction with regard to the hydraulic pressure transmitted to said operation mechanism; and an operation position estimating device that estimates an operation position of an arm of said operation mechanism on the basis of said integrated value, wherein said estimated operation position is calculated by multiplying said integrated value of each of the operation pressures by the coefficient set per operation pressure in accordance with the kind of the work, and adding in the case of the rising (dump) operation or subtracting in the case of the falling (crowd) operation;

an abnormal operation determining device that measures a fluctuation amount of the hydraulic pressure so as to detect with or without an overload operation, in the case that an estimated joint angle satisfies a fixed condition;

wherein in calculation of said joint angle it is determined whether or not a joint output is beyond a previously set threshold value, If said joint output is beyond the threshold value, then an attitude flag is scraped down;

wherein in calculation of said joint angle it is further determined whether or not a total of the fluctuation amount of the of the hydraulic operation pressure is beyond a previously set threshold value, if the total of the fluctuation amount of the hydraulic operation pressure is beyond the threshold value than the overload operation is carried out, and outputs to an external portion of the abnormal operation detecting device.

8. An abnormal operation detection device as claimed in claim 7, wherein the abnormal operation detection device carries out an initialization of the device that estimates the joint angle of said arm.

9. An abnormal operation detection device as claimed in claim 7, further comprising an abnormal operation storage device that stores the detection of said overload operation while adding a data in a storage device provided within the apparatus or connected thereto, at a time of detecting said overload operation.

10. An abnormal operation detection device as claimed in claim 7, further comprising an informing device that informs an operator of the detection of said overload operation, at a time of detecting said overload operation.

11. An abnormal operation detection device as claimed in claim 2, further comprising an abnormal operation storage device that stores an overload operation of said hydraulic shovel while adding a date in a memory device provided in the device or connected thereto, at a time of detecting the overload operation.

12. An abnormal operation detection device as claimed in claim 2, further comprising an informing device that informs an operator of the detection of the overload operation of said hydraulic shovel, at a time of detecting the overload operation.

13. An abnormal operation detection device as claimed in claim 2, further comprising a message device that informs an external portion of the detection of the overload operation of said hydraulic shovel by using a communication device connected to the abnormal operation detection device, at a time of detecting the overload operation.

14. An abnormal operation detection device as claimed in claim 2, wherein the abnormal operation detection device carries out an initialization of said estimated operation position or said estimated angle of said hydraulic shovel.

* * * * *